US006295937B1

(12) United States Patent
Nakanishi et al.

(10) Patent No.: US 6,295,937 B1
(45) Date of Patent: Oct. 2, 2001

(54) INTAKE/EXHAUST TYPE COMBUSTION EQUIPMENT

(75) Inventors: Yutaka Nakanishi; Tomohiko Takeuchi; Hiroyuki Onogawa, all of Aichi-ken (JP)

(73) Assignee: Toyotomi Co., Ltd., Aichi-ken (JP)

( * ) Notice: Subject to any disclaimer, the term of this patent is extended or adjusted under 35 U.S.C. 154(b) by 0 days.

(21) Appl. No.: 09/741,177

(22) Filed: Dec. 21, 2000

(51) Int. Cl.[7] ..... F23N 5/02
(52) U.S. Cl. ..... 110/190; 110/185
(58) Field of Search ..... 110/185, 186, 110/188, 190; 431/75, 76, 68; 432/36, 37; 266/87

(56) References Cited

U.S. PATENT DOCUMENTS

| | | | | |
|---|---|---|---|---|
| 4,547,150 | * | 10/1985 | Vereecke | 432/12 |
| 4,583,936 | * | 4/1986 | Krieger | 431/1 |
| 5,626,086 | * | 5/1997 | Malone | 110/190 |
| 5,730,069 | * | 3/1998 | Collidge et al. | 110/187 |
| 5,730,072 | * | 3/1998 | Wright et al. | 110/345 |
| 5,829,962 | * | 11/1998 | Drasek et al. | 431/79 |
| 5,832,848 | * | 10/1998 | Reynoldson et al. | 110/348 |
| 5,938,423 | * | 9/1999 | Nishiyama et al. | 431/12 |
| 5,957,063 | * | 9/1999 | Koseki et al. | 110/188 |

FOREIGN PATENT DOCUMENTS 302712 11/1993 (JP) .
128623 5/1996 (JP) .

* cited by examiner

*Primary Examiner*—Henry Bennett
*Assistant Examiner*—K. B. Rinehart
(74) *Attorney, Agent, or Firm*—Connolly Bove Lodge & Hutz, LLP

(57) ABSTRACT

An intake/exhaust type combustion equipment capable of permitting oxygen in a proper amount required for stable combustion to be constantly fed to the combustion equipment, irrespective of outdoor air conditions. An intake air temperature detection sensor is arranged for detecting a temperature of combustion air fed to a burner by a combustion air feed fan and an oxygen data output element is arranged for outputting oxygen data corresponding to an oxygen concentration in combustion air depending on the temperature detected by the intake air temperature detection sensor. The oxygen data output element outputs oxygen data on the oxygen concentration or a variation in oxygen concentration based on the detected temperature. A combustion variation unit is configured so as to output a feed rate variation command for varying balance between the amount of fuel fed to the burner and the amount of combustion air fed thereto to ensure that combustion air is fed in a proper amount to the burner, on the basis of the oxygen data. Thus, the combustion variation unit controls a fuel feed element and the combustion air feed fan so that data on the amount of oxygen are obtained from data on a temperature of intake air, to thereby maintain balance between the amount of fuel fed to the burner and the amount of oxygen required for combustion in the burner.

15 Claims, 2 Drawing Sheets

INTAKE/EXHAUST TYPE COMBUSTION EQUIPMENT

BACKGROUND OF THE INVENTION

This invention relates to an intake/exhaust type combustion equipment, and more particularly to an intake/exhaust type combustion equipment adapted to use outdoor air as combustion air and discharge exhaust gas produced by a burner to the outdoors.

A typical intake/exhaust type combustion equipment which has been conventionally known in the art is disclosed in Japanese Patent Application Laid-Open Publication No. 302712/1993, of which the disclosure is incorporated herein by reference. The conventional intake/exhaust type combustion equipment disclosed, which was proposed by the assignee, includes a pot-type burner for combustion arranged in a frame, a fuel feed means for feeding fuel to the burner and a combustion air feed fan arranged in an intake passage for feeding the burner with combustion air introduced from the outdoors. The intake/exhaust type combustion equipment also includes a heat exchanger arranged in an intermediate portion of an exhaust passage which permits exhaust gas to be guided therethrough to the outdoors and constructed so as to carry out heat exchange between combustion gas produced in the burner and indoor air, and a convection fan for flowing indoor air against the heat exchanger.

Another conventional intake/exhaust type combustion equipment which is constructed so as to lead out intake and exhaust passages to the outdoors is disclosed in Japanese Patent Application Laid-Open Publication No. 128623/1996, of which the disclosure is incorporated herein by reference. In the intake/exhaust type combustion equipment, which was likewise proposed by the assignee, an intake pipe and an exhaust pipe are configured into a double-pipe structure.

Also, a further conventional intake/exhaust type combustion equipment is disclosed in Japanese Patent Application Laid-Open Publication No. 302712/1993, of which the disclosure is incorporated herein by reference. The combustion equipment disclosed is so constructed that the amount of fuel fed from a fuel feed means and a rotational speed of a combustion air feed fan are varied depending on the amount of combustion. In the combustion equipment, an increase in combustion is attained by increasing a rotational speed of the combustion air feed fan and a reduction in combustion is carried out by reducing the rotational speed.

When an intake/exhaust type combustion equipment which has a burner incorporated therein is constructed so as to use indoor air as combustion air, combustion operation of the combustion equipment permits air fed to the burner to be readily heated to a temperature at a level of a temperature in a room in which the equipment is placed, resulting in density of the air during combustion operation of the combustion equipment being kept substantially constant, so that balance between the amount of combustion and the amount of oxygen required for keeping the combustion may be maintained to permit the equipment to provide stable combustion.

In the combustion equipment, feed of air to a burner by means of a combustion air feed fan is carried out while varying a rotational speed of a motor for driving the fan to control the amount of combustion air fed to the burner. For this purpose, the fan driving motor has a revolving shaft mounted thereon with a rotational speed detecting sensor, to thereby control the fan driving motor so as to ensure that the motor may be constantly operated at a desired rotational speed. Nevertheless, such arrangement often fails to constantly ensure that oxygen in an amount actually required for combustion is fed to the burner. This fails to maintain proper balance between the amount of fuel fed to the burner and the amount of oxygen contained in air fed thereto by means of the combustion air feed fan, leading to problems such as incomplete combustion due to deficiency of oxygen, malfunction of the combustion equipment due to oversupply of oxygen and the like.

In order to solve the problems, in the prior art, the amount of combustion air fed to the burner by the combustion air feed fan is set to be above a level which permits proper balance between a rotational speed of the combustion air feed fan or the amount of combustion air fed to the burner and the amount of fuel fed thereto, to thereby prevent production of carbon monoxide (CO) gas due to deficiency of oxygen. However, this essentially causes oversupply of oxygen to the burner. Such oversupply is amplified in combustion operation of the combustion equipment under low-temperature conditions which cause air density varied depending on a temperature to be increased.

Oversupply or excess of oxygen causes only a flame reduced in height to be formed during combustion operation of the combustion equipment, leading to malfunction of a safety unit which is arranged in the combustion equipment and has a flame sensor incorporated therein. Also, incomplete combustion in the burner due to deficiency of oxygen causes adhesion of carbon to the burner, leading to a deterioration in thermal efficiency. Further, even when the amount of air is set above a level required for the proper balance as described above, the combustion equipment, which it is operated on a highland of which the height above the sea level is highly increased, causes incomplete combustion due to deficiency of oxygen, because an oxygen concentration is reduced at such a highland.

SUMMARY OF THE INVENTION

The present invention has been made in view of the foregoing disadvantages of the prior art.

Accordingly, it is an object of the present invention to provide an intake/exhaust type combustion equipment which is capable of ensuring that oxygen in a proper amount required for stable combustion is constantly fed to the combustion equipment, irrespective of outdoor air conditions.

It is another object of the present invention to provide an intake/exhaust type combustion equipment which is capable of positively feeding oxygen in an amount required for permitting stable combustion of fuel to the combustion equipment, even when outdid air is excessively reduced in temperature.

It is another object of the present invention to provide an intake/exhaust type combustion equipment which is capable of carrying out satisfactory combustion operation while automatically accommodating to various conditions such as a reduction in oxygen concentration as encountered in combustion operation on a highland, to thereby constantly ensure stable combustion.

The present invention is directed to an improvement in an intake/exhaust type combustion equipment which includes a burner for combustion mounted in a frame arranged indoors, a fuel feed means constructed so as to feed the burner with fuel and permit the amount of fuel fed to the burner to be adjusted, an intake passage arranged so as to permit combustion air to be guided from the outdoors to the burner therethrough, a combustion air feed fan arranged in the air intake passage so as to feed the burner with combustion air introduced to the intake passage from the outdoors and permit the amount of combustion air fed to the burner to be adjusted, an exhaust passage for guiding exhaust gas produced in the burner to the outdoors, and a combustion variation unit for outputting a feed rate variation command to each of the fuel feed means and combustion air feed fan in order to vary combustion in the burner according to a predetermined control mode.

The intake/exhaust type combustion equipment of the present invention includes an intake air temperature detection sensor for detecting a temperature of combustion air fed to the burner by the combustion air feed fan and an oxygen data output means for outputting oxygen data corresponding to an oxygen concentration in combustion air depending on the temperature detected by the intake air temperature detection sensor.

The amount of oxygen required for combustion of fuel fed to the burner is substantially varied depending on outdoor air conditions. Thus, even when the combustion air feed fan is rotated at a constant rotational speed, a variation in density of air causes a variation in quantity of oxygen fed to the burner. A variation in density of air is reversely proportional to a variation in temperature. Thus, a decrease in temperature causes an increase in oxygen concentration, whereas an increase in temperature causes a reduction in oxygen concentration. This is true irrespective of a variation in atmospheric pressure. Thus, when relationship between a temperature of combustion air and an oxygen concentration in the combustion air is previously obtained, it is possible to directly or indirectly know an oxygen concentration in the combustion air or a variation in oxygen concentration based on a temperature of the combustion air measured or detected.

The oxygen data output means outputs oxygen data on the oxygen concentration or a variation in oxygen concentration based on the detected temperature. The combustion variation unit is configured so as to output the feed rate variation command for varying balance between the amount of fuel fed to the burner and the amount of combustion air fed thereto, to thereby permit combustion air to be fed in a proper amount to the burner, on the basis of the oxygen data. Thus, the combustion variation unit controls the fuel feed means and combustion air feed fan so that data on the amount of oxygen are obtained from data on a temperature of intake air, to thereby properly maintain balance between the amount of fuel fed to the burner and the amount of oxygen required for combustion in the burner.

For example, in the case that the amount of fuel fed to the burner is not varied, the combustion variation unit may be constructed so as to output a feed rate variation command which permits the amount of combustion air fed to the burner or a rotational speed of the combustion air feed fan to be reduced when the oxygen data indicate an increase in oxygen concentration as compared with a standard oxygen concentration and to be increased when the oxygen data indicate a reduction in oxygen concentration as compared with the standard oxygen concentration.

In the case that the amount of combustion air fed to the burner or a rotational speed of the combustion air feed fan is not varied, the combustion variation unit may be constructed so as to output a feed rate variation command which permits the amount of fuel fed to the burner to be increased when the oxygen data indicate an increase in oxygen concentration as compared with the standard oxygen concentration and reduced when the oxygen data indicate a reduction in oxygen concentration as compared with the standard oxygen concentration.

Both the amount of combustion air fed to the burner and the amount of fuel fed thereto may be varied to vary balance between the amount of fuel and the amount of combustion air, to thereby ensure that oxygen is fed in a proper amount to the burner. More particularly, the present invention may be so constructed that the combustion variation unit is previously stored therein with proper balance relationship between the amount of fuel fed to the burner and the amount of combustion air fed to the burner depending on combustion and configured to output the feed rate variation command to each of the fuel feed means and combustion air feed fan so that the balance relationship may be maintained depending on a variation in combustion when the combustion is varied according to the control mode. In this instance, the combustion variation unit may be constructed to vary a timing of variation in rotational speed of the combustion air feed fan and/or a timing of variation in fuel feed rate of the fuel feed means according to the control mode, to thereby ensure that oxygen is fed in a proper amount to the burner, depending on the oxygen data.

A variation in atmospheric pressure causes a variation in oxygen concentration in air. For example, when a combustion equipment is operated on a highland such as a top of a mountain, an oxygen concentration in combustion air is reduced even when a temperature is varied, because an atmospheric pressure is below a standard pressure. Thus, correction of the above-described oxygen data depending on an atmospheric pressure permits a variation in oxygen concentration due to a variation in atmospheric pressure to be corrected. For this purpose, the present invention may be constructed in such a manner that an atmospheric pressure sensor is arranged so as to detect an atmospheric pressure to output atmospheric pressure data corresponding to the atmospheric pressure detected and an oxygen data correction means is arranged so as to correct the oxygen data outputted from the oxygen data output means by means of the atmospheric pressure data. The oxygen data correction means may be constructed, when the atmospheric pressure is reduced to a level below a standard atmospheric pressure, so as to carry out correction of reducing an oxygen concentration in the oxygen data corresponding to a reduction in the atmospheric pressure. The oxygen data correction means may be arranged in either the oxygen data output means or the combustion variation unit. This permits balance between the a rotational speed of the combustion air feed fan and a fuel feed rate of the fuel feed means to be varied for correction depending on the atmospheric pressure data outputted from the atmospheric pressure sensor. For example, when the combustion equipment is operated on a highland in which density of air is reduced, correction is made to increase a rotational speed of the combustion air feed fan. Also, a variation in fuel feed rate of the fuel feed means in correspondence to a combustion air feed rate of the combustion air feed fan ensures stable combustion in the combustion equipment in view of both a variation in temperature of intake air and the height above the sea level of a place in which the combustion equipment is operated.

The burner incorporated in the intake/exhaust type combustion equipment of the present invention may be constructed into any desired structure. However, it is preferably a pot-type burner The pot-type burner may include a bottom-closed pot including a side wall formed with a plurality of through-holes, an air channel arranged so as to define a space outside the pot which permits combustion air fed from the combustion air feed fan to be flowed therethrough, and a combustion member arranged in the pot. Such construction of the pot-type burner, when the amount of air flowing through the burner is increased, effectively prevents the increase from adversely affecting combustion in the burner, to thereby ensure stable combustion.

In a preferred embodiment of the present-invention, the intake passage and exhaust passage have sections constructed so as to provide a double-pipe structure in cooperation with each other, respectively, so that combustion air is heated by exhaust gas in the double-pipe structure. In this instance, the intake air temperature detection sensor may be arranged at a portion of the intake passage extending from the double-pipe structure to the burner.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, an intake/exhaust type combustion equipment according to the present invention will be described with reference to the accompanying drawings.

Figure 1:
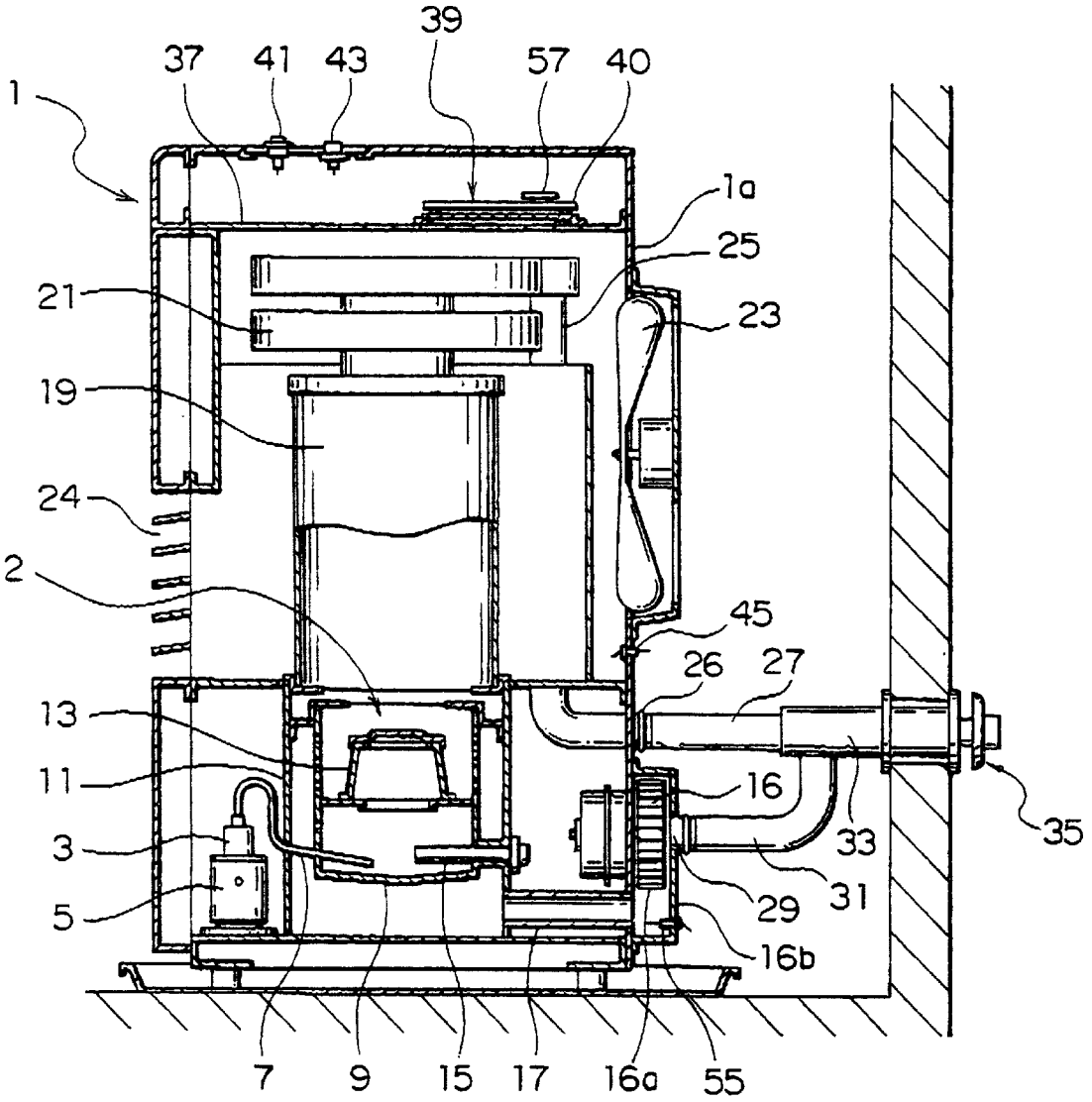
FIG. 1 is a sectional view showing an embodiment of an intake/exhaust type combustion equipment according to the present invention.
Figure 2:
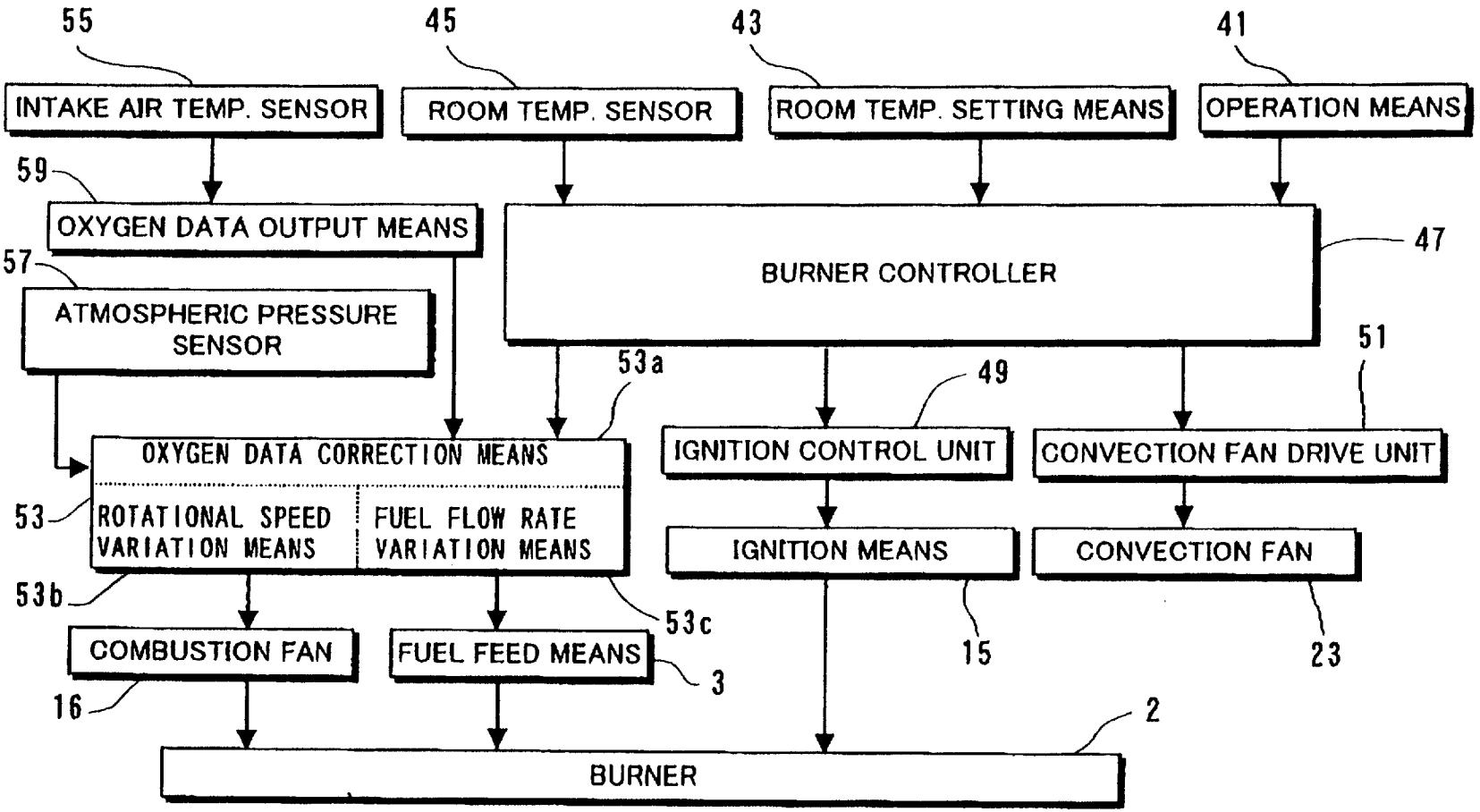
FIG. 2 is a block diagram showing a combustion control unit incorporated in the intake/exhaust type combustion equipment of FIG. 1.

Referring to FIGS. 1 and 2, an embodiment of an intake/exhaust type combustion equipment according to the present invention is illustrated. An intake/exhaust type combustion equipment of the illustrated embodiment is basically constructed in substantially the same manner as the combustion equipment disclosed in each of Japanese Patent Application Laid-Open Publications Nos. 302712/1993 and 128623/1996 described above. The combustion equipment includes a frame 1, which has a burner 2 and a fuel pump constituting a fuel feed means 3 received therein. The fuel pump acting as the fuel feed means 3 is constituted by an electromagnetic pump which permits a fuel feed rate to be varied depending on a feed rate variation control command. Thus, the fuel feed means 3 is controlled by a feed rate variation control command inputted thereto from a combustion variation unit arranged in the frame 1 and constructed as described below, to thereby control the amount of fuel fed to the burner 2. The intake/exhaust type combustion equipment of the illustrated embodiment also includes an oil leveler 5 which is arranged below the fuel feed means 3 and fed with fuel (kerosine) from an fuel tank (not shown). The oil leveler 5 functions to keep a level of oil therein constant. Fuel in the oil leveler 5 is pumped up by the fuel pump or fuel feed means 3 and then forcibly fed through a nozzle 7 into the burner 2.

The pot-type burner 2 includes a pot 9 which is formed into a configuration like a bottom-closed cylinder and in which fuel fed to the burner 2 is subjected to combustion. The pot 9 includes a side wall formed with a plurality of through-holes or air holes. The pot 9 is surrounded with a cylindrical member with an air channel 11 being defined therebetween. The pot 9 is provided therein with a combustion member 13 and a ceramic heater 15 for pre-heating of the pot 9 and ignition of fuel therein. The burner 2 is configured so as to permit fuel and combustion air to be fed to the pot 9, resulting in vaporization of the fuel and combustion thereof being concurrently carried out therein. Combustion air is fed via the through-holes of the side wall of the pot 9 into the pot 9- Such construction of the burner 2 ensures that even when a part of air passes through the pot 9 without contributing to combustion therein, the pot carries out stable combustion unless the part is excessively increased in quantity.

The air channel 11 is fed with outdoor air through a duct 17 by means of a combustion air feed fan 16 constituted by a cirrocco fan. The combustion air fed into the air channel 11 is then fed through the plural through-holes or air holes of the side wall of the pot 9 into the pot 9. Then, ignition takes place in the pot by means of the ceramic heater 15 being red-heated, resulting in combustion starting in the pot.

Above the burner 2 is arranged a combustion chamber 19 in a manner to communicate with the burner 2. Then, above the combustion chamber 19 is arranged a heat exchanger 21 so as to communicate with the combustion chamber 19. Also, the intake/exhaust type combustion equipment of the illustrated embodiment includes a convection fan 23 arranged behind the combustion chamber 19. The convection fan 23 functions to forcibly feed air in a room in which the combustion equipment is placed into the frame 1 in which the burner 2, combustion chamber 21 and heat exchanger 21 are arranged. The heat exchanger 21 functions to carry out heat exchange between combustion gas and air in the room. Air in the room thus heated by the heat exchanger 21 is blown as hot air from a hot air outlet 24 provided on a front side of the frame 1 into the room.

Combustion gas subjected to heat exchange in the heat exchanger 21 and then discharged from the heat exchanger 21 is exhausted in the form of exhaust gas through an exhaust pipe 25 and an exhaust outlet 26 to an exterior of the frame 1. In the illustrated embodiment, the exhaust outlet 26 is constituted by a short pipe arranged on a rear side of the frame 1. The exhaust outlet 26 is connected to one end of an additional exhaust pipe 27 for discharging the exhaust gas to the outdoors therethrough.

The combustion air feed fan 16 constituted by the cirrocco fan includes an impeller 16*a* and an air duct 16*b*, which are arranged outside-a rear plate 1*a* of the frame 1. The frame 1 is formed with a communication hole in a manner to communicate with an outlet of the air duct 16*b* and the duct 17 is connected at one end thereof to the communication hole. The air duct 16*b* is provided at a central portion thereof with an air intake port 29, which is constituted by a short pipe. The air intake port 29 has one end of an air intake pipe 31 connected thereto. The other end of the air intake pipe 31 and that of the exhaust pipe 27 are constructed into a double-pipe structure 33 wherein the air intake pipe 31 is arranged outside the exhaust pipe 27. The double-pipe structure 33 thus constructed is then led out to the outdoors through an outer wall of a building. The double-pipe structure 33 has an intake/exhaust top 35 connected to a distal end thereof. The intake/exhaust top 35 is configured so as to permit both intake of air and exhaust of exhaust gas to be carried out therethrough. Such a double-pipe structure and intake/exhaust top are described in detail in Japanese Patent Application Laid-Open Publication No. 128623/1996 as described above.

The frame has a partition plate 37 arranged therein so as to define a partitioned or closed space above the heat exchanger 25. Above the partition plate 37 is arranged a combustion control unit 39. The combustion control unit 39 includes a burner controller 47 (FIG. 2). The burner controller 47 is fed with an operation signal from each of an operation means 41 constituted by an operation start switch and a room temperature setting means 43 constituted by a temperature setting switch which are arranged on a top plate of the frame 1. Also, the burner controller 47 is fed with a room temperature detection signal from a room temperature sensor 45 mounted on the rear plate 1*a* of the frame 1 so as to detect a temperature in the room.

The burner controller 47, as shown in FIG. 2, is fed with an operation signal from the operation means 45, to thereby output a command signal to each of an ignition control unit 49, a convection fan drive unit 51 and a combustion variation unit 53 according to a predetermined control mode.

The combustion variation unit 53 includes an oxygen data correction means 53*a*, a rotational speed variation means 53*b* and a fuel feed rate variation means 53*c*,which will be described in detail hereinafter. The combustion variation unit 53 is fed with a command signal from the burner controller 47, an output of the oxygen data output means 59 for converting an output of an intake air temperature detection sensor 55 (FIGS. 1 and 2) into oxygen data, and an output of an atmospheric pressure sensor 57 (FIGS. 1 and 2) arranged in the frame 1 so as to measure an atmospheric pressure to output a signal depending on the atmospheric pressure measured. The intake air temperature detection sensor 55 is arranged in proximity to the outlet of the combustion air feed fan 16 to measure a temperature of combustion air fed to the burner 2. The atmospheric pressure sensor 57 is mounted on a controller board 40 which is arranged at a suitable position of the frame 1 and on which a body of the burner controller 47, a variety of peripheral control mechanisms and the like are mounted. The atmospheric pressure sensor 57 functions to measure or detect the height above the sea level of a site in which the intake/exhaust type combustion equipment is operated.

The oxygen data output means outputs oxygen data corresponding to an oxygen concentration in combustion air on the basis of a temperature detected by the intake air temperature detection sensor 55. The oxygen data may be outputted in the form of a numerical value. They may be outputted in such a manner that a quantity or concentration of oxygen contained in air of a fixed volume is displayed as a concrete numerical value. However, the illustrated embodiment is not limited to such a manner. For example, the oxygen data may be outputted in the form of a deviation or an exponent obtained by comparison with either the amount of oxygen required for normal operation of the combustion equipment or a standard oxygen concentration. Alternatively, the oxygen data may be outputted in the form of any specific numerical value suitable for the combustion variation unit 53 to vary a rotational speed of the combustion air feed fan 16 or a fuel flow rate of the fuel feed means 3. In any event, the oxygen data output means may be constructed in any desired manner so long as it is adapted to satisfactorily output a signal corresponding to the oxygen concentration.

For example, the oxygen data output means 59 may be constructed so as to have data indicating relationship between an oxygen concentration and a temperature previously measured stored therein, to thereby judge or determine an oxygen concentration corresponding to a temperature of combustion air based on the data, resulting in outputting a signal proportional to the oxygen concentration. Alternatively, it may be constructed so as to output oxygen data on an oxygen concentration as a variation with respect to a reference level or standard concentration which is an oxygen concentration at a standard temperature. The atmospheric pressure sensor 57 may be constituted by a suitable sensor commercially available. The atmospheric pressure sensor 57 is adapted to output an electric signal depending on an atmospheric pressure measured. An output of the atmospheric pressure sensor 57 is fed to the oxygen data correction means 53*a* provided in the combustion variation unit 53. The oxygen data correction means 53*a* may be configured to function as a component for the oxygen data output means 59. In this instance, the output of the atmospheric pressure sensor 57 is fed to the oxygen data output means 59- The oxygen data correction means 53*a*, when an atmospheric pressure is reduced to a level below a standard pressure, is configured so as to carry out correction of reducing an oxygen concentration contained in the oxygen data depending on the reduction in atmospheric pressure- The correction is not carried out when the atmospheric pressure is equal to the standard pressure. When the atmospheric pressure is reduced to a level below the standard pressure, the correction is carried out in a manner to multiply the oxygen data by a factor below one (1) depending on a degree of the reduction. Thus, it will be noted that the correction can be readily attained.

The combustion variation unit 53 is configured to output, on the basis of the oxygen data, a feed rate variation command to the fuel feed means 3 constituted by the drive unit-equipped combustion air feed fan 16 and electromagnetic pump. The feed rate variation command is adapted to vary balance between the amount of fuel fed to the burner 2 and the amount of combustion air fed thereto so as to prevent excess or deficiency of oxygen fed to the burner 2 or ensure that oxygen is fed in a proper amount to the burner 2. The feed rate variation command is outputted from each of the rotational speed variation means 53*b* and fuel flow rate variation means 53*c*. In other words, in the intake/exhaust type combustion equipment of the present invention, data on the amount of oxygen are induced from data on intake air, so that the combustion variation unit 53 may control the fuel feed means 3 and combustion air feed fan 16 so as to constantly ensure proper balance between the amount of fuel fed to the burner 2 and the amount of oxygen fed thereto.

The burner controller 47 is configured so as to receive an operation start signal from the operation means 41 and a signal indicating a set temperature from the room temperature setting means 43, to thereby feed an operation command to each of the ignition control unit 49, convection fan control unit 51 and combustion variation unit 53. This results in the ignition control unit 49 first heating the ignition means 15, to thereby increase a temperature in the pot 9 to a level which permits fuel to be ignited in the pot 9. Then, the fuel feed means 3 feeds fuel to the pot 9 and the combustion air feed fan 16 feeds combustion air to the pot 9 from the outdoors. This permits the fuel to be ignited in the pot, so that combustion is started in the pot 9. Upon start of the combustion, operation of the convection fan 23 is started, resulting in heated air in a room in which the intake/exhaust type combustion equipment is placed being fed to the heat exchanger 21. The burner controller 47 outputs a necessary command according to a predetermined control mods including an operation start mode defined between ignition and stable combustion and a temperature control mode required for permitting a temperature in the room to reach the set temperature. In the temperature control mode, proper balance between the amount of combustion air fed to the pot 9 by means of the combustion air feed fan 16 or a rotational speed of the fan 16 and the amount of fuel fed to the pot 9 from the fuel feed means 3 is previously determined and various commands are outputted so as to keep the balance.

The combustion variation unit 53 is operated when a control command is fed thereto from the burner controller 47. When the oxygen concentration indicated by the oxygen data which are fed from the oxygen data output means 59 through the oxygen data correction means 53*a* to the combustion variation unit 53 is equal to the standard concentration or within a predetermined range about the standard concentration, the rotational speed variation means 53*b* and fuel flow rate variation means 53*c* of the combustion variation unit 53 output necessary variation commands to the combustion air feed fan 16 and fuel feed means 3 depending on the command from the burner controller 47, respectively. When the combustion variation unit responds to the command from the burner controller 47 without taking any step in the case that the oxygen concentration indicated by the oxygen data is varied and more particularly increased or reduced due to a reduction in outdoor temperature, the intake/exhaust type combustion equipment fails to ensure that oxygen is fed in a proper amount to the burner 2. In order to avoid the problem, the rotational speed variation means 53*b* and fuel flow rate variation means 53*c* of the combustion variation unit 53 output a feed rate variation command for varying the balance between the amount of fuel fed to the burner 2 and the amount of combustion air fed thereto to each of the combustion air feed fan 16 and fuel feed means 3, to thereby ensure that oxygen is fed in a proper amount to the burner 2 or prevent excess or deficiency of oxygen fed to the burner. The feed rate variation command may be obtained by varying the command from the burner controller 47. A variation in balance between the amount of fuel fed to the burner and the amount of combustion air fed thereto may be carried out in any desired manner so long as it attains the above-described function.

For example, when the amount of fuel fed to the burner is not varied, the following procedure may be employed. When the oxygen data indicate that the oxygen concentration is increased to a level above the standard concentration, the rotational speed variation means 53*b* outputs a feed rate variation command to the combustion air feed fan 16 in order to reduce the amount of combustion air fed to the burner (or reduce a rotational speed of the combustion air feed fan 16) depending on a difference between the oxygen concentration and the standard concentration. On the contrary, when the oxygen data indicate that the oxygen concentration is below the standard concentration, the rotational speed variation means 53*b* outputs a feed rate variation command to the combustion air feed fan 16 so as to increase the amount of combustion air fed to the burner 2 (or increase a rotational speed of the combustion air feed fan 16) depending on a difference in concentration. A degree of reduction or increase in combustion air may be previously determined by an experiment. For example, it may be carried out by multiplication by a factor.

When the amount of combustion air fed to the burner 2 or a rotational speed of the combustion air feed fan 16 is not varied in the case that the oxygen concentration is different from the standard concentration, the following procedure may be taken. First, when the oxygen data indicate that the oxygen concentration is above the standard concentration, the fuel flow variation means 53*c* outputs a feed rate variation command to the fuel feed means 3 so as to increase the amount of fuel fed to the burner depending on a difference between the oxygen concentration and the standard concentration. Whereas, when the oxygen data indicate that the oxygen concentration is below the standard concentration, the fuel flow rate variation means 53*c* outputs a feed rate variation command to the fuel feed means 3 so as to reduce the amount of fuel fed to the burner depending on a difference between the oxygen concentration and the standard concentration. A degree of reduction or increase in fuel quantity fed to the burner may be previously determined by an experiment. It may be carried out by multiplication by a factor.

Alternatively, balance between the amount of fuel fed to the burner 2 and the amount of combustion air fed thereto may be varied so as to ensure that oxygen is fed in a proper amount to the burner by varying both the amount of combustion fed to the burner 2 and the amount of fuel fed thereto. In this instance as well, a degree of increase or reduction in rotational speed of the combustion air feed fan 16 and that in fuel quantity may be previously determined by an excrement.

When combustion is controlled according to the control mode of varying the amount of combustion in the burner depending on proper balance between the amount of fuel fed to the burner and that of combustion air fed thereto, the balance may be readily varied by varying (or advancing or delaying) a timing of variation in rotational speed of the combustion air feed fan 16 and/or a timing of variation in a fuel feed rate of the fuel feed means 3. For example, in the case that the oxygen data indicate that the oxygen concentration is above the standard level or concentration when the control mode is at a step of increasing the amount of combustion of fuel, it may be carried out to delay a timing of variation in rotational speed of the combustion air feed fan 16 according to the control mode. Also, in the case that the oxygen data indicate that the oxygen concentration is above the standard concentration when the control mode is at a step of reducing the combustion, a timing of variation in rotational speed of the fan 16 according to the control mode may be advanced.

When the intake/exhaust type combustion equipment of the illustrated embodiment is operated on a highland wherein an atmospheric pressure is reduced, the oxygen data correction means 53*a* corrects an output of the oxygen data output means 59 depending on an output of the atmospheric pressure sensor 57. The oxygen data correction means 53*a*, when an atmospheric pressure is decreased to a level below a standard atmospheric pressure, carries out correction which permits the oxygen concentration in the oxygen data to be reduced depending on the reduction in atmospheric pressure. This results in balance between a rotational speed of the combustion air feed fan 16 and a fuel feed rate of the fuel feed means 3 being varied by correction depending on atmospheric pressure data outputted from the atmospheric pressure sensor 57. Basically, when the intake/exhaust type combustion equipment is operated on a highland which causes an atmospheric pressure to be decreased, the correction may be carried Qut, for example, in a manner to increase a rotational speed of the combustion air feed fan 16 or reduce the amount of fuel fed to the burner 2, to thereby maintain balance between the amount of fuel fed to the burner 2 and the amount of combustion fed thereto.

Now, a variation in balance due to a variation in timing will be described more in detail. In order to maintain balance between the amount of fuel fed to the burner 2 or a fuel feed rate and the amount of combustion air fed thereto or a combustion air feed rate, the combustion variation unit 53 carries out operation of varying a change-over timing of a rotational speed of the combustion air feed fan 16 with respect to the amount of fuel fed to the burner 2 through the fuel feed means 3. Thus, depending on data on an oxygen quantity or oxygen concentration outputted from the oxygen data output means 59, the combustion variation unit 53 varies (or advances or delays) a change-over timing of a rotational speed of the combustion air feed fan 16 corresponding to the amount of fuel fed to the burner or the fuel feed rate. When the intake air temperature detection sensor 55 detects a temperature below the standard temperature, the oxygen data outputted from the oxygen data output means 14 exceed the standard level. In other words, the data indicate that the oxygen concentration is increased. Thus, the combustion variation unit 53 delays a change-over timing of a rotational speed of the combustion air feed fan 16 as compared with a normal change-over timing at which the fuel feed means 3 changes over the fuel feed rate. This permits the combustion air feed rate to be increased by changing-over after the fuel feed rate is increased to a level above a normal level. Such a highland causes a reduction in oxygen concentration in the atmosphere. Thus, the combustion variation unit 53 advances a change-over timing of reducing the amount of fuel fed to the burner 2 by the fuel feed means 3, as compared with that in operation of the combustion equipment on a flat land. Further, the change-over timing may be varied so as to increase a rotational speed of the combustion air feed fan 16 when the fuel feed rate is reduced.

The intake air temperature detection sensor 55 may be arranged at any desired location, so long as it permits measurement or detection of a temperature of air introduced into the intake/exhaust type combustion equipment from the outdoors. For example, it may be located at any desired position in the air intake passage. However, when the intake/exhaust top 35 is constructed into the double-pipe structure 33 as in the illustrated embodiment or the air intake passages as indicated at 17 and 31 and exhaust passage as indicted at 25 are increased in length, temperature data detected may be often varied to a degree depending on a position at which the intake air temperature detection sensor 55 is arranged. When the intake air temperature detection sensor 55 is positioned in the air intake passage extending between the air intake port 29 of the frame 1 and the burner 2 as in the illustrated embodiment, it may detect a temperature of combustion air increased by heating due to heat exchange at the double-pipe structure 33. This permits detection or measurement of an actual temperature of combustion air fed to the burner 2 through the combustion air feed fan 16. This results in the burner 2 attaining stable combustion as compared with direct measurement of a temperature of outdoor air. Arrangement of the intake air temperature detection sensor 55 in proximity to the outlet of the combustion air feed fan 16 facilitates mounting of the sensor and replacement thereof.

Also, when the exhaust pipe 27 and intake pipe 31 through which the intake/exhaust top 35 and air intake port 29 are connected to each other are increased in length or formed with many bents, both pipes are increased in flow resistance. Such conditions often fail to permit oxygen in an amount required for combustion to be fed to the burner 2, even when the combustion air feed fan 16 is rotated at a rotational speed balanced with the amount of fuel fed by the fuel feed means 3. In view of the problem, in the illustrated embodiment, a cirrocco fan is used as the combustion air feed fan 16. Also, as shown in FIG. 1, the intake air temperature detection sensor 55 is arranged in the air duct 16*b* of the cirrocco fan 16 exposed to air flow in the flow passage extending from the air intake port 29 to the burner 2. Further, the intake air temperature detection sensor 55 is constituted by a thermistor device. In order to operate a thermistor device, it is required to flow a bias current in a small amount through the thermistor device, to thereby permit it to generate heat by itself. Thus, the thermistor device tends to output temperature data somewhat higher than actual air temperature data due to the self-heat generation. However, arrangement of the thermistor device in air blown out of the combustion air feed fan 16 as in the illustrated embodiment permits the thermistor to discharge heat to the air being flowed, so that the thermistor may output rather low temperature data. This permits temperature correction under such installation conditions to be carried out to a degree. Also, the amount of heat discharged from the thermistor device can be highly accurately anticipated or estimated from a rotational speed of the combustion air feed fan 16 in a normal operation state. Thus, the estimated heat dissipation permits correction of a temperature detected by the intake air temperature detection sensor 55, resulting in temperature data under standard installation conditions being gained.

In the case that the exhaust pipe 27 and intake pipe 31 through which the intake/exhaust top 35 and air intake port 29 are connected to each other are increased in length or formed with many bents, the amount of oxygen fed to the burner is reduced when a rotational speed of the combustion air feed fan 16 is kept at a level of the rotational speed set under the normal installation conditions, resulting in abnormal combustion possibly occurring in the burner. However, when a flow rate of air is reduced by flow resistance in the pipes 27 and 31, self-heat generation of the thermistor device is increased as compared with the case that heat is discharged from the thermistor to air flowed in the pipes, so that a temperature detected by the intake air temperature detection sensor 55 is considerably high as compared with the actual temperature.

Such an increase in temperature detected means a reduction in oxygen quantity or concentration in combustion air. Thus, the combustion variation unit 53 carries out operation of increasing a rotational speed of the combustion air feed fan 16 or reducing a fuel feed rate of the fuel feed means 3. This results in incomplete combustion by oxygen deficiency due to an increase flow resistance owing to an increase in length of the exhaust pipe 27 and/or intake pipe 31 being automatically or necessarily avoided.

The components of the control unit shown in FIG. 2 each may be realized by means of a microcomputer. In particular, the burner controller 47, combustion variation unit 53 and oxygen data output means 59 each may be constituted using a microcomputer.

In the illustrated embodiment, the burner 2 is constructed in the form of a pot-type burner. Thus, the burner 2 ensures stable combustion even when the amount of air passing through the pot per unit time is somewhat varied. Thus, an inexpensive AC motor which is constructed so as to lead changeover taps out of a motor coil, to thereby vary a combustion air feed rate depending on selection of the taps may be used as a motor for the combustion air feed fan 16. When such an AC motor is used for the combustion air feed fan 16, the combustion air feed fan 16 may be constructed so as to stepwise vary the combustion air feed rate, to thereby accommodate to linear variation in fuel quantity fed to the burner 2.

However, a variety of burners may be used for such intake/exhaust type combustion equipment. Typically, a Bunsen burner which is constructed so as to gasify liquid fuel by heating to burn the gasified fuel is used for this purpose Such a burner is adapted to previously mix gas fuel with a predetermined amount of air to prepare mixed gas and ignite the mixed gas while ejecting the gas from a flame hole. Thus, use of such a burner for the intake/exhaust type combustion equipment of the present invention is highly effective for stable combustion. The Bunsen burner readily causes incomplete combustion when a mixing ratio between fuel and combustion air required for preparation of mixed gas is out of a proper range. Thus, oxygen quantity data inputted to the combustion variation unit 53 are preferably linear oxygen quantity data prepared on the basis of temperature data of the intake air temperature detection sensor 55 and outputted from the oxygen data output means 59. When such a burner is applied to the intake/exhaust type combustion equipment of the present invention, the combustion equipment is desirably constructed so as to permit a rotational speed of the combustion air feed fan 16 and the amount of fuel fed from the fuel feed means 3 to be smoothly varied.

The above-described construction of the illustrated embodiment permits oxygen in an amount required for stable combustion of fuel fed to the burner to be positively fed to the burner even when outdoor air is highly reduced in temperature, to thereby prevent generation of incomplete combustion depending on conditions of outdoor air as encountered in the prior art.

Also, combustion is substantially affected by not only a variation in temperature of air fed to the burner 2 but the height above the sea level of a location at which the combustion equipment is operated. When a combustion equipment adapted to be operated on a flatland is operated on a highland 1000 meters above the sea level, the combustion equipment often fails to provide stable combustion. In the illustrated embodiment, an output of the oxygen data output means 53*a* is corrected by means of pressure data outputted from the atmospheric pressure sensor 57. Such construction permits the combustion equipment to automatically correspond to operation thereof on a highland wherein an oxygen concentration is reduced, so that it may constantly ensure stable combustion.

Further, arrangement of the intake air temperature detection sensor 55 in the flow passage extending between the air intake port 29 and the burner 2 permits detection of a temperature of combustion air fed by the combustion air feed fan 16. This results in the combustion equipment exhibiting stable combustion; even when the intake/exhaust top 35 constructed into the double-pipe structure 33 increased in length is arranged, the exhaust pipe 27 and intake pipe 31 are increased in length, or a temperature in a room in which the combustion equipment is placed is varied to a degree sufficient to affect a temperature of combustion air.

The combustion variation unit 53 is constructed so as to operate the combustion air feed fan 16 and fuel feed means 3 together, to thereby ensure satisfactory balance between the fuel feed rate and the combustion air feed rate. Also, when the combustion variation unit 53 includes the rotational speed variation means 53*b* and fuel flow rate variation means 53*c* as described above, so that the combustion air feed fan 16 and fuel feed means 3 may be individually controlled, the rotational speed variation means 53*b* and fuel flow rate variation means 53*c* may be controlled by oxygen quantity data outputted from the oxygen data output means 59 and an output of the burner controller 4. respectively.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An intake/exhaust type combustion equipment comprising:

a burner for combustion mounted in a frame arranged indoors;

a fuel feed means constructed so as to feed said burner with fuel and permit the amount of fuel fed to said burner to be adjusted;

an intake passage arranged so as to permit combustion air to be guided from the outdoors to said burner therethrough;

a combustion air feed fan arranged in said air intake passage so as to feed said burner with combustion air introduced to said intake passage from the outdoors and permit the amount of combustion air fed to said burner to be adjusted;

an exhaust passage for guiding exhaust gas produced in said burner to the outdoors;

a combustion variation unit for outputting a feed rate variation command to each of said fuel feed means and combustion air feed fan in order to vary combustion in said burner according to a predetermined control mode;

an intake air temperature detection sensor for detecting a temperature of combustion air fed to said burner by said combustion air feed fan; and an oxygen data output means for outputting oxygen data corresponding to an oxygen concentration in combustion air depending on the temperature detected by said intake air temperature detection sensor;

said combustion variation unit being configured so as to output said feed rate variation command for varying balance between the amount of fuel fed to said burner and the amount of combustion air fed thereto to ensure that combustion air is fed in a proper amount to said burner, on the basis of said oxygen data.

2. An intake/exhaust type combustion equipment as defined in claim 1, wherein said combustion variation unit outputs said feed rate variation command so as to reduce the amount of combustion air fed to said burner when said oxygen data indicate an increase in oxygen concentration and increase the amount of combustion air fed thereto when said oxygen data indicate a reduction in oxygen concentration.

3. An intake/exhaust type combustion equipment as defined in claim 1, wherein said combustion variation unit outputs said feed rate variation command so as to increase the amount of fuel fed to said burner when said oxygen data indicate an increase in oxygen concentration and reduce the amount of fuel fed thereto when said oxygen data indicate a reduction in oxygen concentration.

4. An intake/exhaust type combustion equipment as defined in claim 1, wherein said combustion variation unit is constructed to vary a timing of variation in rotational speed of said combustion air feed fan and/or a timing of variation in fuel feed rate of said fuel feed means according to said control mode to ensure that oxygen is fed in a proper amount to said burner, depending on said oxygen data, when said control mode causes combustion to be varied on the basis of proper balance relationship between the amount of fuel fed to said burner and the amount of combustion air fed thereto depending on the combustion.

5. An intake/exhaust type combustion equipment as defined in claim 4, wherein said combustion variation unit is constructed so as to delay the timing of variation in rotational speed of said combustion air feed fan according to said control mode when said oxygen data indicate that said oxygen concentration is above a standard concentration, in the case that said control mode is at a step of increasing the combustion; and said combustion variation unit is also constructed so as to advance the timing of variation in rotational speed of said combustion air feed fan according to said control mode when said oxygen data indicate that said oxygen concentration is above the standard concentration, in the case that said control mode is at a step of reducing the combustion.

6. An intake/exhaust type combustion equipment as defined in claim 1, further comprising an atmospheric pressure sensor for detecting an atmospheric pressure to output atmospheric pressure data corresponding to the atmospheric pressure detected; and an oxygen data correction means for correcting said oxygen data outputted from said oxygen data output means by means of said atmospheric pressure data.

7. An intake/exhaust type combustion equipment as defined in claim 6, wherein said oxygen data correction means, when said atmospheric pressure is reduced to a level below a standard atmospheric pressure, carries out correction of reducing an oxygen concentration in said oxygen data corresponding to a reduction in said atmospheric pressure.

8. An intake/exhaust type combustion equipment as defined in claim 1, wherein said intake passage and exhaust passage have sections constructed so as to provide a double-pipe structure in cooperation with each other, respectively; and said intake air temperature detection sensor is arranged at a portion of said intake passage extending from said double-pipe structure to said burner.

9. An intake/exhaust type combustion equipment as defined in claim 8, wherein said intake air temperature detection sensor is constituted by a thermistor device and arranged in proximity to an outlet of said combustion air feed fan.

10. An intake/exhaust type combustion equipment as defined in claim 9, wherein said combustion air feed fan is arranged outside said frame.

11. An intake/exhaust type combustion equipment as defined in claim 1, wherein said burner is a pot-type burner.

12. An intake/exhaust type combustion equipment as defined in claim 11, wherein said pot-type burner includes a bottom-closed pot including a side wall formed with a plurality of through-holes, an air channel arranged so as to define a space outside said pot which permits combustion air fed from said combustion air feed fan to be flowed therethrough, and a combustion member arranged in said pot.

13. An intake/exhaust type combustion equipment as defined in claim 11, wherein said combustion air feed fan is driven by a fan drive motor:

said fan drive motor being constituted by an AC motor which is so constructed that a rotational speed thereof is stepwise varied by tap changing-over.

14. An intake/exhaust type combustion equipment comprising:

a burner for combustion mounted in a frame arranged indoors;

a fuel feed means constructed so as to feed said burner with fuel and permit the amount of fuel fed to said burner to be adjusted;

an intake passage arranged so as to permit combustion air to be guided from the outdoors to said burner therethrough;

a combustion air feed fan arranged in said air intake passage so as to feed said burner with combustion air introduced to said intake passage from the outdoors and permit the amount of combustion air fed to said burner to be adjusted;

an exhaust passage for guiding exhaust gas produced in said burner to the outdoors;

a heat exchanger arranged at an intermediate portion of said exhaust passage to carry out heat exchange between heat of combustion gas produced in said burner and indoor air, to thereby heat the air;

a convection fan arranged so as to blow indoor air against said heat exchanger;

a combustion variation unit for outputting a feed rate variation command to each of said fuel feed means and combustion air feed fan in order to vary combustion in said burner according to a predetermined control mode;

an intake air temperature detection sensor for detecting a temperature of combustion air fed to said burner by said combustion air feed fan: and an oxygen data output means for outputting oxygen data corresponding to an oxygen concentration in combustion air depending on the temperature detected by said intake air temperature detection sensor;

said combustion variation unit being previously stored therein with proper balance relationship between the amount of fuel fed to said burner and the amount of combustion air fed to said burner depending on combustion and constructed so as to output said feed rate variation command to each of said fuel feed means and combustion air feed fan so that said balance relationship may be maintained depending on a variation in combustion when the combustion is varied according to said control mode;

said combustion variation unit being also constructed so as to vary, depending on said oxygen data, a timing of variation in rotational speed of said combustion air feed fan and/or a timing of variation in fuel feed rate of said fuel feed means according to said control mode, to thereby ensure that oxygen is fed in a proper amount to said burner.

15. An intake/exhaust type combustion equipment as defined in claim 12, wherein said combustion air feed fan is driven by a fan drive motor;

said fan drive motor being constituted by an AC motor which is so constructed that a rotational speed thereof is stepwise varied by tap changing-over.

* * * * *